United States Patent [19]

Studinka et al.

[11] 3,992,504

[45] Nov. 16, 1976

[54] PROCESS FOR PRODUCING WET SPUN OR SHAPED STRUCTURES

[75] Inventors: Josef Studinka; Gabler Rudolf, both of Zurich, Switzerland

[73] Assignee: Inventa AG fur Forschung und Patentverwertung, Zurich, Switzerland

[22] Filed: July 23, 1975

[21] Appl. No.: 598,535

Related U.S. Application Data

[63] Continuation of Ser. No. 431,466, Jan. 7, 1974, abandoned.

[30] Foreign Application Priority Data

Jan. 16, 1973 Switzerland ..... 556/73

[52] U.S. Cl. ..... 264/184; 264/203

[51] Int. Cl.[2] ..... D01F 6/00

[58] Field of Search ..... 264/184, 203; 260/78.4 R, 78 R, 78.41

[56] References Cited

UNITED STATES PATENTS

| | | | |
|---|---|---|---|
| 3,671,542 | 6/1972 | Kwolek | 260/30.8 R |
| 3,767,756 | 10/1973 | Blades | 264/184 |
| 3,886,251 | 5/1975 | Sekiguchi et al. | 264/184 |

*Primary Examiner*—Jay H. Woo

*Attorney, Agent, or Firm*—Bierman & Bierman

[57] ABSTRACT

Fibers and yarn and a process for preparing them comprising dissolving in concentrated sulfuric acid a polymer containing at least 75 mol percent of an aromatic poly-(1,3,4-oxadiazole) having the repeating structural formula

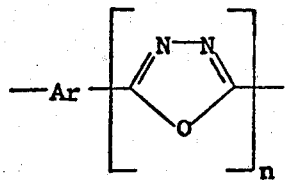

I in which Ar is

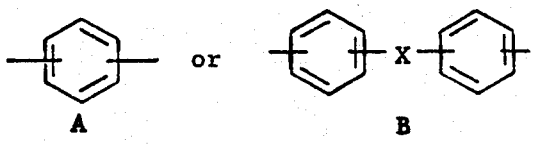

A B the benzene rings in A or B being substituted or unsubstituted; the linking bonds in A being situated m- or p- with respect to each other, and in B situated m- or p- with respect to X; X being $—SO_2—$ or —CO—; and n being 1 or 2. The solution is then spun through a spinneret into a substantially water-free precipitating medium of at least one liquid having the formula (II)

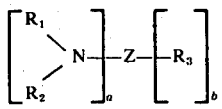

II in which $R_1$, $R_2$ and $R_3$ may be the same or different and are alkyl groups having 1 to 4 carbon atoms, and $R_3$ may also be H, and in which $R_1$ and $R_2$ or $R_1$ and $R_3$ may together comprise a divalent alkylene radical, the total number of carbon atoms in $R_1$, $R_2$ and $R_3$ being not more than 8, and in which Z is

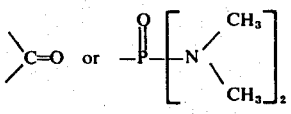

*a* being equal to 1 or 2, *b* being equal to the valence of Z.

7 Claims, No Drawings

PROCESS FOR PRODUCING WET SPUN OR SHAPED STRUCTURES

This is a Rule 60 Continuation Application of copending Ser. No. 431,466, filed Jan. 7, 1974, now abandoned the priority of which is hereby claimed, which application claims the priority of Swiss Application No. 556/73 filed Jan. 16, 1973, the priority of which was already claimed. The present invention relates to a process for producing wet spun or shaped structures and to the structures obtained by this process, in particular abrasion-resistant tire cord yarn.

Aromatic poly-1,3,4-oxadiazoles are polymers with a high resistance to changes of temperature, their melting points generally being about 400° to 500° C. Synthetic fibers of these polymers have high tenacity, low stretch and are insensitive to organic solvents and to hydrolytic decomposition. For these reasons they are of great interest as industrial fiber material. The preparation of these polymers, the spinning thereof and the general properties of their fibers have been described in the literature. Representative of the literature are A. H. Frazer and D. R. Wilson, Appl. Polymer Symposia 9, 89, (1969), Y. Iwakura, K. Uno and S. Hara, J. Polymer Sci. A 3, 45 (1965), Y. Imai, J. Appl. Polymer Sci. 14, 225 (1970).

Despite their numerous advantageous properties, however, fibers of poly-1,3,4-oxadiazole have the disadvantage of having low abrasion resistance. This is because of the rigidity of the polymer molecules, which in turn is a consequence of the lack of movable intermediate members between the aromatic rings. It is possible — and has moreover already been proposed in patent applications — to incorporate movable bridging members between the aromatic rings of polyoxadiazoles by special monomers, thereby improving abrasion and wear resistance. However, this technique has the great disadvantage of minimizing the other advantageous properties of the polyoxadiazoles, such as high melting point, etc.

It is also known that the abrasion resistance of synthetic fibers is a direct function of the molecular weight. (R. Hill, Fasern aus synthetischen Polymeren (Fibers of Synthetic Polymers), Stuttgart 1956, p. 419). Swiss Patent Application No: 15 981/70, Ser. No.421 describes how poly-1,3,4-oxadiazoles with particularly high molecular weights can be prepared by employing chlorosulphonic acid during the polycondensation. It was also found at the same time, however, that the molecular weight of the polyoxadiazoles is reduced as soon as the sulphuric acid solution of the polymer is brought into contact with water or media containing water. The same observation is made when the polymer solution is spun into a water-containing precipitating bath to form filaments, as described, for example, in British Patent Specification 1,252,508. Substantially lower molecular weights are measured in such filaments than in the initial spinning solutions and, accordingly, the abrasion resistance values also do not attain the expected values.

Surprisingly, it has now been found that this reduction in molecular weight can be avoided when wet spun or shaped structures such as fibers, films or strips consisting of at least 75 mol-% of an aromatic poly-1,3,4-oxadiazole having a repeating structural formula (I)

I

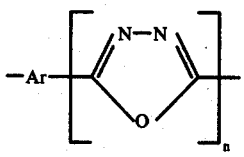

in which Ar signifies a radical of the formula

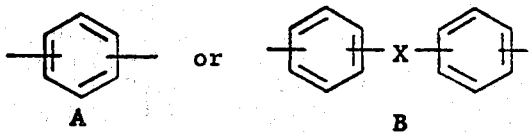

A B and in which the benzene rings may be substituted or unsubstituted. The linking bonds between the rings in structure A can be m- or p-positioned with respect to one another, and those in B can be m- or p- positioned with respect to X. X represents $-SO_2-$ or

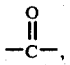

and $n$ can be 1 or 2. According to the invention, a solution of such a polymer in concentrated sulphuric acid is forced through a spinneret into a non-aqueous and substantially water-free precipitating bath which consists of at least one liquid precipitating medium of formula II

II

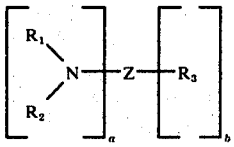

in which $R_1$, $R_2$ and $R_3$ may be the same or different and represent alkyl groups having 1 to 4 carbon atoms, and $R_3$ may also be H. $R_1$ and $R_2$ or $R_1$ and $R_3$ together may represent bivalent alkylene radicals, the total number of C atoms in $R_1$, $R_2$ and $R_3$ together being not more than 8, $a$ is 1 or 2, $b$ is 0 or 1, Z is the radical

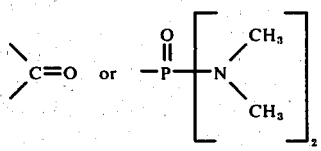

and the sum $a + b$ is equal to the valence of the radical Z.

As indicated, $R_1$, $R_2$ and $R_3$ may signify individual alkyl groups or two of these groups at a time may also be combined in an alkylene group, thus forming a heterocyclic ring. Preferably, if a heterocyclic ring of this kind is present, it contains a total of 5 to 7 nuclear atoms.

In a preferred embodiment, the structures of this invention consist in a proportion of at least 90 mol-% of poly (1,3,4-oxadiazole) with a structural unit of formula I. The remainder consists of structural units containing the formula —CONHNHCO— instead of the oxadiazole radical. $n$ is preferably 1.

Preferably, the benzene rings in structures A and B are unsubstituted. However, substituted rings are also within the scope of this invention. Such substitutents can include halogens such as fluorine, chlorine and bromine.

A preferred structure which is particularly suitable especially for the manufacture of abrasion-resistant yarns contains 50 mol-% of structural units of formula C and 50 mol-% of the structural units of formula D.

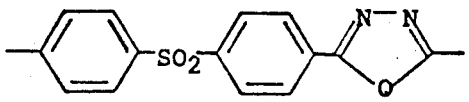

C

Up to about 5% of these two structures may contain the radical —CONHNHCO— instead of the oxadiazole radical.

Non-aqueous precipitation media of formula II employed according to the invention are, for example:

N,N-dimethyl formamide
N,N-dimethyl acetamide
N,N-dimethyl propionamide
N,N-diethyl formamide
N-methyl-N-ethyl acetamide
N-methylpyrrolidone
N-methylcaprolactam
N-ethylvalerolactam
N,N,N', N'-tetramethylurea
N,N,N',N'-tetraethylurea
N,N', N''-hexamethyl phosphoric acid triamide The preferred precipitation medium is N,N-dimethyl formamide. A mixture of two or more of such precipitation media may also be employed. Since substantial absence of water is necessary for maintaining the molecular weight of the present polymers the water content of the precipitation agents should be kept below about 5%. The precipitation medium is preferably as free from water as possible. A water content of 0.01 – 0.2% is in the preferred working range. If there are few —CONHNHCO— groups (<3%) present in the polymer, the water content of the precipitation medium may be up to about 1%, and in exceptional cases up to about 5%, without disadvantage. The temperature of the precipitating bath may be varied within a wide range, limited only by the solidification point and the boiling point of the precipitation medium. The preferable temperature range is from about 10° to 40° C.

The concentration of the polymer with structural units of formula I in the concentrated sulphuric acid can range from 2 to 20 per cent, and is advantageously 5 to 12%. When this spinning solution comes into contact with the precipitating bath, a considerable amount of heat is produced and must be removed by cooling. This is best done by the precipitating medium being pumped through a cooling circuit by means of a cooling thermostat.

The gradual increase in the concentration of the sulphuric acid in the precipitating bath is not critical. The sulphuric acid content may increase from 0 to 20% by weight (with respect to the precipitating medium) without any detectable variation in quality of the structures produced. In this respect, the precipitating baths employed according to the invention differ advantageously from conventional aqueous media in which variations of the sulphuric acid concentration of ±5% by weight (with respect to the precipitating medium) have a marked effect on coagulation conditions and, consequently, on the quality of the resultant fibers.

By utilizing the present invention it is now possible to obtain finished products of 1,3,4-oxadiazole polymers having molecular weights relatively unchanged from those of the starting material polymers. These conditions are illustrated in Table 1. Three poly-1,3,4-oxadiazoles of different initial molecular weights were extruded on the one hand into a conventional precipitating bath of 50% sulphuric acid and on the other hand into two different precipitating baths according to the present invention.

TABLE I.

| | RSV*** | Dependence on | Coagulation Conditions |
|---|---|---|---|
| | Reduced specific viscosity (RSV) | | Reduced specific viscosity (RSV) |
| Polymer | Before spinning | Precipitating bath | After spinning** |
| A* | 5.86 | 50/50% : Sulphuric acid/ water | 4.66 |
| B* | 12.24 | | 6.08 |
| C* | 24.80 | | 8.22 |
| A | 5.86 | Dimethyl formamide | 5.82 |
| B | 12.24 | | 12.01 |
| C | 24.80 | | 24.53 |
| A | 5.86 | Dimethyl acetamide | 5.78 |
| B | 12.24 | | 11.95 |
| C | 24.80 | | 24.43 |

*prepared from 50/50 mol-% of isophthalic acid and terephthalic acid, and also dihydrazine sulphate in chlorosulphonic acid.
**extruded through a 100-aperture spinneret with an aperture diameter of 120 μ into a precipitating bath at a temperature of 30° C.
***RSV=ηrel-l/c, C=0.2% by volume solution in 96% sulphuric acid at 20° C.

No method is known as yet of determining the absolute molecular molecular weight of poly-1,3,4-oxadiazoles from measured physical or chemical values. The solvent viscosity has therefor been used in Table 1 above as indicative to the relative molecular weights. It is apparent from the Table that when aqueous sulphuric acid is employed as precipitating bath a reduction in the RSV values is observed which increases with increasing initial molecular weight. In the case of polymer C, the reduction in the RSV is 67% of the initial value. In comparison, the reduction in the RSV when DMF or dimethyl acetamide is employed remains insignificant and is within the error limit of the method of determination.

With the aid of the precipitating baths according to the invention it has therefore become possible for the first time to produce wet spun fibers, films and strips with very high molecular weights. The effect of this on abrasion resistance is shown in Table 2. The abrasion tests were carried out by the Hasler method on single filaments having a thickness of 2.5 – 5 den. with a load of 0.25 g/den. in a modified bending and chafing apparatus (see K. Grunwald, Chemiefasern 12, 853 (1962). The loaded filaments were pulled back and forth at an angle of 90° over a 2 mm diameter steel wire at a rate of 60 revolutions per minute until they broke. For comparison, the Table also contains the abrasion values of acrylic fiber, polyester fiber and nylon.

Table II.

Relative abrasion numbers of poly-1,3,4-oxadiazole fibers of different molecular weights in comparison with commercial synthetic fibers

| Fiber | Size den. | RSV | Abrasion number until break |
|---|---|---|---|
| Poly-1,3,4-oxadiazole | 3.0 | 4.66 | $1.1 \times 10^6$ |
| Poly-1,3,4-oxadiazole | 2.8 | 7.50 | $10.5 \times 10^6$ |
| Poly-1,3,4-oxadiazole | 2.5 | 11.95 | $5.2 \times 10^7$ |
| Acrylic fiber | 3.0 | (Commercial) | $8.6 \times 10^4$ |
| Polyester fiber | 5.0 | (Tire-cord | $1.7 \times 10^6$ |
| Nylon 6 | 3.0 | quality) | $5.1 \times 10^6$ |

This Table shows clearly the molecular-weight or RSV dependence of the abrasion resistance of polyoxadiazole fibers. At low molecular weights corresponding to RSV values of 3 to 5, the abrasion numbers are between those of acrylic and polyester fibers. With RSV values between 7.5 and 12, the abrasion numbers of commercial polyester and nylon tire-cord yarn are considerably exceeded.

Abrasion-resistant poly-1,3,4-oxadiazole fibers of high molecular weight which have been produced by the wet spinning process according to the invention are outstandingly suitable for many industrial purposes, particularly for the manufacture of conveyor belts, driving belts and tire cord. A typical tire-cord yarn consisting of fibers obtained in accordance with this invention has a typical tenacity of 8.5 g/den., a stretch of 3%, an initial modulus of 230 g/den. and an abrasion resistance which exceeds that of comparable polyester and nylon cord yarns.

The invention is illustrated more fully by the following Examples.

EXAMPLE 1

A polyphenylene-1,3,4-oxadiazole containing 25% meta- and 75% para-phenylene linkage and having a reduced specific viscosity of 8.41 was used for the spinning test.

The spinning solution consisted of 10% by weight of polymer and 90% by weight of conc. sulphuric acid.

The solution passed from the acid-resistant supply vessel under a pressure of 2.5 atms. to a geared spinning pump, which sent the spinning solution to a tantalum spinneret, having 100 apertures, each with a diameter of 0.120 mm. Dimethyl formamide was used as the precipitating medium and the bath temperature was between 30° and 35° C. The rate of issue of the bundle of filaments was 3.6 m/min. After passing through a coagulation section with a length of 140 cm, the yarn was taken up on a reel at a rate of 4.0 m/min. and carried on into a washing bath. Here the yarn was passed through a hot-water section (75° – 80° C) 160 cm long and was stretched to 2.6 times its length. The winding was effected at a rate of 10.4 m/min. The reel was washed overnight with running water and then dried at 70° C. The yarn obtained was completely acid-free, colorless, lustrous and transparent.

The properties of the fiber were as follows:

| | |
|---|---|
| Size | 4.5 den. |
| Tenacity | 4.3 g/den. |
| Stretch | 35% |
| Initial modulus | 65 g/den. |

The properties of the fiber can be further improved by a hot after-treatment. To this end, the yarn was conveyed through a nitrogen-flushed heating duct with a length of 63 cm and an internal temperature of 430° C and stretched to 1.32 times its length. The winding rate was 4.63 m/min.

The properties after the heat treatment were as follows:

| | |
|---|---|
| Size | 3.8 den. |
| Tenacity | 9.3 g/den. |
| Stretch | 4% |
| Initial modulus | 230 g/den. |

The individual fibers had a uniform circular cross-section in which neither occulusions nor hollow spaces could be detected. In addition to the high strength values, the polyoxadiazole yarn also showed an extraordinary resistance to hydrolysis. After 6 hours of pressure treatment in water at 130° C, no decrease in molecular weight could be detected. The abrasion resistance of the individual fibers of the yarn found by the Hasler method was $1.3 \times 10^7$ strokes until break.

EXAMPLE 2

A polyoxadiazole having recurring units of the formula

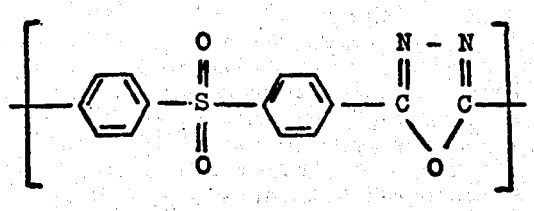

was spun. The spinning solution contained 11% by weight of the above polymer with a RSV of 11.2, dissolved in conc. sulphuric acid. The dynamic viscosity of the solution was 21,000 poises.

The spinning was effected through a 100-aperture spinneret, the apertures each being 0.120 mm in diameter, into a dimethyl acetamide precipitating bath. The bundle of filaments passed through a coagulation section with a length of 2.2 m and was taken up on a first reel at a rate of 6.7 m/min. From here the yarn was passed into a washing and stretching bath with a length of 2.5 m, where after-drawing by 220% was effected in water at a temperature of 80° C. The yarn was taken up on the stretching reel at a rate of 14.75 m/min., washed overnight in running cold water and dried at 70° C.

Testing by the conventional methods gave the following properties for the fiber:

| | |
|---|---|
| Size | 2.8 den. |
| Tenacity | 3.8 g/den. |
| Stretch | 42% |
| Initial modulus | 51 g/den. |

The hot after-treatment was carried out at 435° C with the aid of the apparatus indicated in Example 1, the yarn being stretched to 1.71 times its length.

After this treatment, the strength values of the fiber were increased to the following values:

| | |
|---|---|
| Tenacity | 8.5 g/den. |
| Stretch | 3% |
| Initial modulus | 260 g/den. |

EXAMPLE 3

Essentially, the spinning test of Example 1 was repeated, with the difference that N-methylpyrrolidone was employed as precipitating medium.

The result was a yarn with the following properties:

| | |
|---|---|
| Size | 4.3 den. |
| Tenacity | 3.5 g/den. |
| Stretch | 58% |
| Initial modulus | 48 g/den. |

Hot stretching at 420° C in a ratio of 1 : 1.9 resulted in a significant increase in the strength values:

| | |
|---|---|
| Size | 2.7 den. |
| Tenacity | 7.8 g/den. |
| Stretch | 8% |
| Initial modulus | 195 g/den. |

The density of the hot-stretched fiber was 1.4189 g/cm³. X-ray diffraction analysis pointed to a moderate crystallization with a low angle of orientation. The relative wet, knot and loop strengths were 85, 78 and 75%, respectively.

The residual strength after heating for 100 hours to 300° C in air was 85 – 96%. The poly-1,3,4-oxadiazole fibers according to the invention obtain their optimum properties after a final hot-drawing operation in the dry state. One such method consists of drawing of the yarn over a flat iron type heated metal surface. In another preferred form of the hot-drawing operation the yarn is pulled under tension through a heated tube with counter-current preheated nitrogen. The length of the tube may vary between 60 and 300 cm, its diameter may vary between 2 and 4 cm.

The temperature of the hot tube or the flat-iron type metal surface is maintained at 300° – 500° C, depending on the yarn speed which may vary between 3 and 300m per minute. Practical draw ratios are in the range of 1:1.1 to 1:3, however, higher draw ratios are possible if low draw ratios are applied in the hot water predrawing step.

What is claimed is:

1. A process for preparing a shaped structure such as a fiber, film or strip of an aromatic poly-(1,3,4-oxadiazole) which consists essentially of:

a. preparing a polymer of an aromatic 1,3,4-oxadiazole, said polymer comprising at least 90 percent of the repeating structural formula I

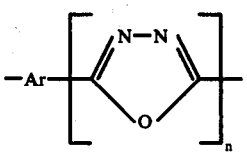

I in which Ar is a radical of the formula

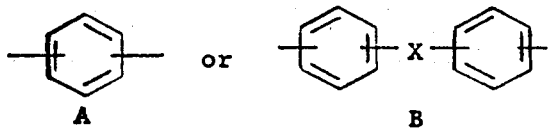

A B the benzene rings of A and B being substituted or unsubstituted, the linking bonds of structure A being m- or p- to each other and those of B being m- or p- to X, X being —$SO_2$— or —CO— and $n$ being 1 or 2;

b. dissolving said polymer in concentrated sulfuric acid;

c. forming the dissolved polymer into a shaped structure;

d. passing the thus-formed structure into a bath which consists essentially of at least one liquid of the formula

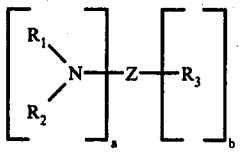

II in which $R_1$ and $R_2$, same or different, are alkyl groups having 1 to 4 carbon atoms, $R_3$ being H or an alkyl group having 1 to 4 carbon atoms, or $R_1$ together with $R_2$ or $R_3$ being a divalent alkylene radical, the total number of carbon atoms in $R_1$, $R_2$ and $R_3$ being not more than 8; Z being

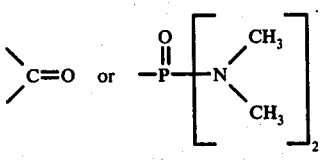

$a$ being 1 or 2, $b$ being 0 or 1 and the sum of $a+b$ being equal to the valence of Z said bath containing below about 5% water; and e. recovering the shaped structure.

2. The process of claim 1 in which the structure formed comprises fibers, said fibers being formed by spinning the polymer solution through a spinneret.

3. The process of claim 2 in which the fibers are recovered from the bath and subjected to a heat treatment which comprises passing the fibers through a heat duct containing a substantially inert atmosphere at a temperature of about 300° to 500° C.

4. The process of claim 2 in which the bath consists essentially of N,N-dimethyl formamide, N,N-dimethyl acetamide, N,N-dimethyl propionamide, N,N-diethyl formamide, N-methyl-N-ethyl acetamide, N-methylpyrrolidone, N-methylcaprolactam, N-ethylvalerolactam, N,N,N',N'-tetramethylurea, N,N,N',N'-tetraethylurea, N,N',N''-hexamethyl phosphoric acid triamide, or mixtures thereof.

5. The process of claim 2 in which the bath comprises substantially water-free N,N-dimethyl formamide.

6. The process of claim 1 in which the bath contains less than about 5% water.

7. The process of claim 1 wherein X is an —$SO_2$— group.

* * * * *